US007793762B2

(12) United States Patent
Zaharia et al.

(10) Patent No.: US 7,793,762 B2
(45) Date of Patent: Sep. 14, 2010

(54) DESTINATION ENTRY PASSENGER INTERFACE WITH MULTIPLE FUNCTIONS

(75) Inventors: Vlad Zaharia, Rocky Hill, CT (US); Michael P. Flynn, Avon, CT (US); Christopher Pietrzykowski, Unionville, CT (US)

(73) Assignee: Otis Elevator Company, Farmington, CT (US)

( * ) Notice: Subject to any disclaimer, the term of this patent is extended or adjusted under 35 U.S.C. 154(b) by 611 days.

(21) Appl. No.: 11/718,007

(22) PCT Filed: Nov. 30, 2004

(86) PCT No.: PCT/US2004/040010

§ 371 (c)(1),
(2), (4) Date: Apr. 26, 2007

(87) PCT Pub. No.: WO2006/059983

PCT Pub. Date: Jun. 8, 2006

(65) Prior Publication Data

US 2009/0133969 A1 May 28, 2009

(51) Int. Cl.
*B66B 1/34* (2006.01)

(52) U.S. Cl. ..... 187/396; 187/391

(58) Field of Classification Search ..... 187/247, 187/391–396
See application file for complete search history.

(56) References Cited

U.S. PATENT DOCUMENTS

| | | | | |
|---|---|---|---|---|
| 3,973,648 | A * | 8/1976 | Hummert et al. | 187/393 |
| 4,697,243 | A * | 9/1987 | Moore et al. | 706/59 |
| 4,930,604 | A * | 6/1990 | Schienda et al. | 187/393 |
| 5,557,546 | A * | 9/1996 | Fukai et al. | 702/185 |
| 5,616,894 | A | 4/1997 | Nieminen et al. | |
| 6,330,935 | B1 | 12/2001 | Systermans | |
| 6,425,460 | B2 | 7/2002 | Schuster | |
| 7,004,289 | B2 | 2/2006 | Shrum, III et al. | |
| 2003/0057029 | A1 * | 3/2003 | Fujino et al. | 187/391 |

* cited by examiner

*Primary Examiner*—Jonathan Salata
(74) *Attorney, Agent, or Firm*—Carlson, Gaskey & Olds PC

(57) ABSTRACT

An elevator system (20) uses destination entry dispatching techniques. A passenger interface device (22) operates in a first mode to allow passengers (24) to enter destination requests for elevator service. The passenger interface (22) operates in a second mode to provide at least one additional feature to an authorized individual. The additional feature may be at least one of a service-related function, a security-related function, a monitoring-related function or a communication-related function.

24 Claims, 2 Drawing Sheets

DESTINATION ENTRY PASSENGER INTERFACE WITH MULTIPLE FUNCTIONS

1. FIELD OF THE INVENTION

This invention generally relates to elevator systems. More particularly, this invention relates to a passenger interface useful with destination entry elevator systems.

2. DESCRIPTION OF THE RELATED ART

Traditional elevator systems rely upon hall call buttons next to a landing entrance to an elevator car for passengers to request service. Upon arrival of the car, the passenger enters the car and then utilizes a car operating panel to indicate the intended destination. Such systems are effective for many situations.

Some elevator systems benefit from alternative arrangements. One alternative is the so-called destination entry technique, which includes having passengers enter their intended destinations from outside of an elevator car. The passenger interface is typically located in an elevator lobby so that passengers can place a call by entering their intended destinations. Known techniques for assigning elevator cars are used to respond to such calls.

The introduction of such destination entry systems provides advantages for effectively managing elevator traffic for a variety of situations. At the same time, however, certain complexities are introduced for situations outside of normal elevator operation. For example, a mechanic attempting to perform a maintenance procedure, for example, can no longer rely upon traditional techniques for obtaining access to the top of an elevator car, for example.

With traditional arrangements including hall call buttons, a mechanic can use known techniques for acquiring access to a selected elevator car, for example, which includes using the hall call buttons. With destination entry systems, the hall call buttons are typically not present or disabled whenever an elevator car is sent to the landing where the hall call buttons are present. There is a need for an alternative arrangement in destination entry-based systems to facilitate elevator service procedures, for example.

It is not desirable for a mechanic to use a destination entry system to place a destination request to a floor below the landing where the top of car access is desired. Using such a technique still requires multiple attempts to capture the desired car. Additionally, the mechanic should only unlock the hoistway doors when the car is traveling in a downward direction. Directional indicators are typically not installed in destination entry-based elevator systems, which places the mechanic at a disadvantage.

Another difficulty associated with destination entry based systems with respect to service procedures is that some passengers already assigned to a car that a mechanic then places into service will have to re-enter their destinations to obtain appropriate service.

Regardless of the system configuration, improvements in facilitating maintenance or service procedures is needed. With a traditional arrangement, a mechanic typically spends a relatively long time attempting to capture a desired car in a desired location. A mechanic must have sufficient experience to properly time unlocking hoistway doors so that a car stops at a proper level for safe access to the car top, for example. In most cases, multiple attempts are required to achieve proper car position.

This invention provides enhancements to an elevator system that facilitates various procedures outside of normal system operation.

SUMMARY OF THE INVENTION

An example device designed according to an embodiment of this invention includes a passenger interface that operates in a first mode to allow a passenger to enter an indication of an intended destination from outside of an elevator car. The passenger interface also operates in a second mode to provide at least one other feature to an authorized individual, such as a mechanic.

In one example, the passenger interface initiates the second mode responsive to an authorization signal. Various authorization signals may be used to provide an indication that an individual has the appropriate authorization to utilize the passenger interface in the second mode. In one example, the second mode includes various levels of accessibility. For example, a building owner may be provided access to certain functions at a first level of authorization while a mechanic is provided access to a larger variety of functions because of a different authorization level.

In one example, the additional feature comprises facilitating a service procedure. Various service procedures can be carried out using the passenger interface in the second mode. A variety of such procedures are disclosed below.

In another example, the passenger interface operates simultaneously in the first mode and the second mode so that a selected one of the elevator cars may be withdrawn from normal system operation. At the same time, passengers can continue using the passenger interface and other elevator cars of the system.

The various features and advantages of this invention will become apparent to those skilled in the art from the following detailed description. The drawing that accompanies the detailed description can be briefly described as follows.

DETAILED DESCRIPTION OF THE PREFERRED EMBODIMENT

Figure 1:
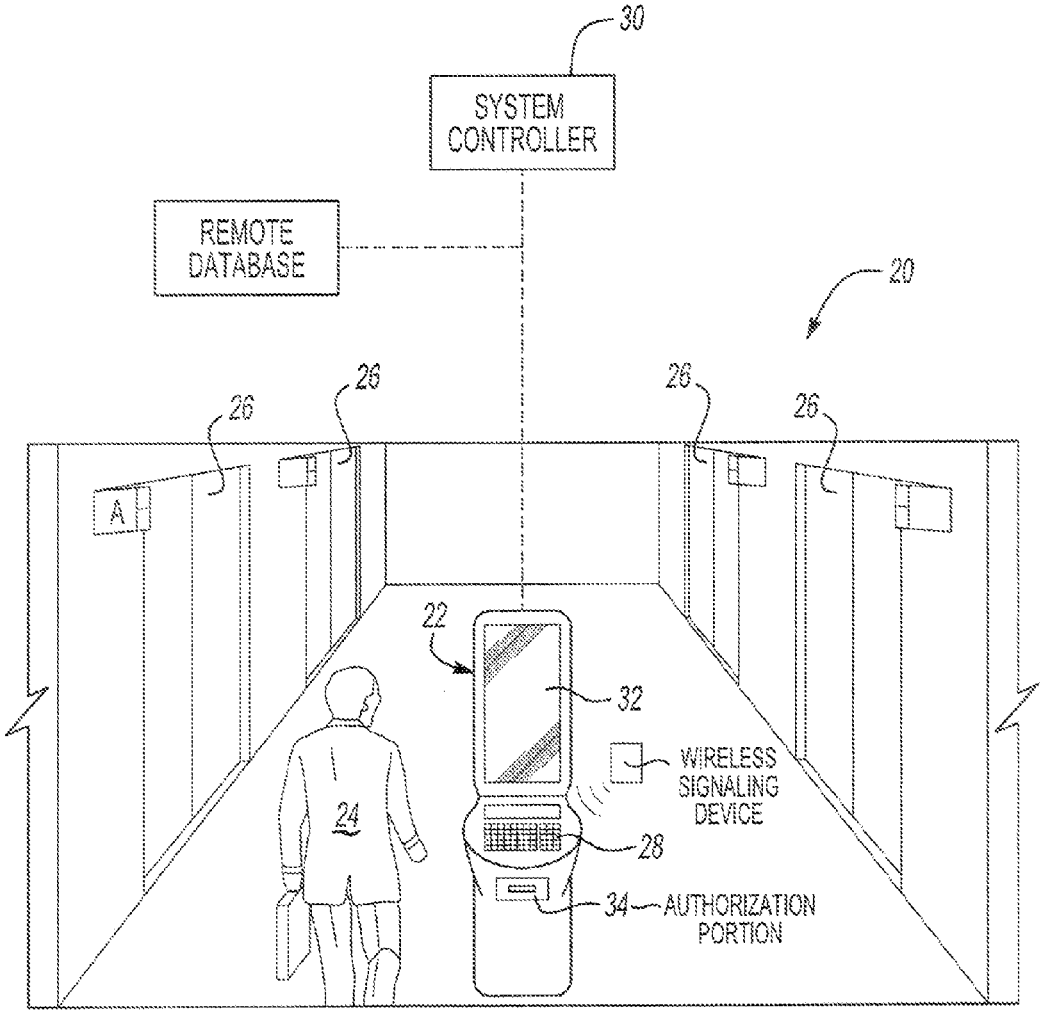
FIG. 1 schematically illustrates selected portions of an elevator system including a passenger interface designed according to an embodiment of this invention.

FIG. 1 schematically shows selected portions of an elevator system 20. A passenger interface 22 allows a passenger 24 to place a call for elevator service. The passenger interface 22 allows the passenger 24 to provide an indication of an intended destination while the passenger 24 is outside of one of the elevator cars 26.

In the illustrated example, an input portion 28 allows the passenger 24 to provide the intended destination indication. In one example, the input portion 28 comprises a keypad. In another example, the input portion comprises a touch screen.

A system controller 30 uses known techniques for assigning an elevator car to respond to a passenger request placed at the passenger interface 22. The illustrated example includes a display portion 32 to direct passengers to appropriate elevator cars in a known manner, for example.

When the passenger interface 22 facilitates passengers entering intended destinations, the passenger interface is operating in a first mode. The passenger interface 22 and the system controller 30 use known techniques when operating in the first mode.

Figure 2:
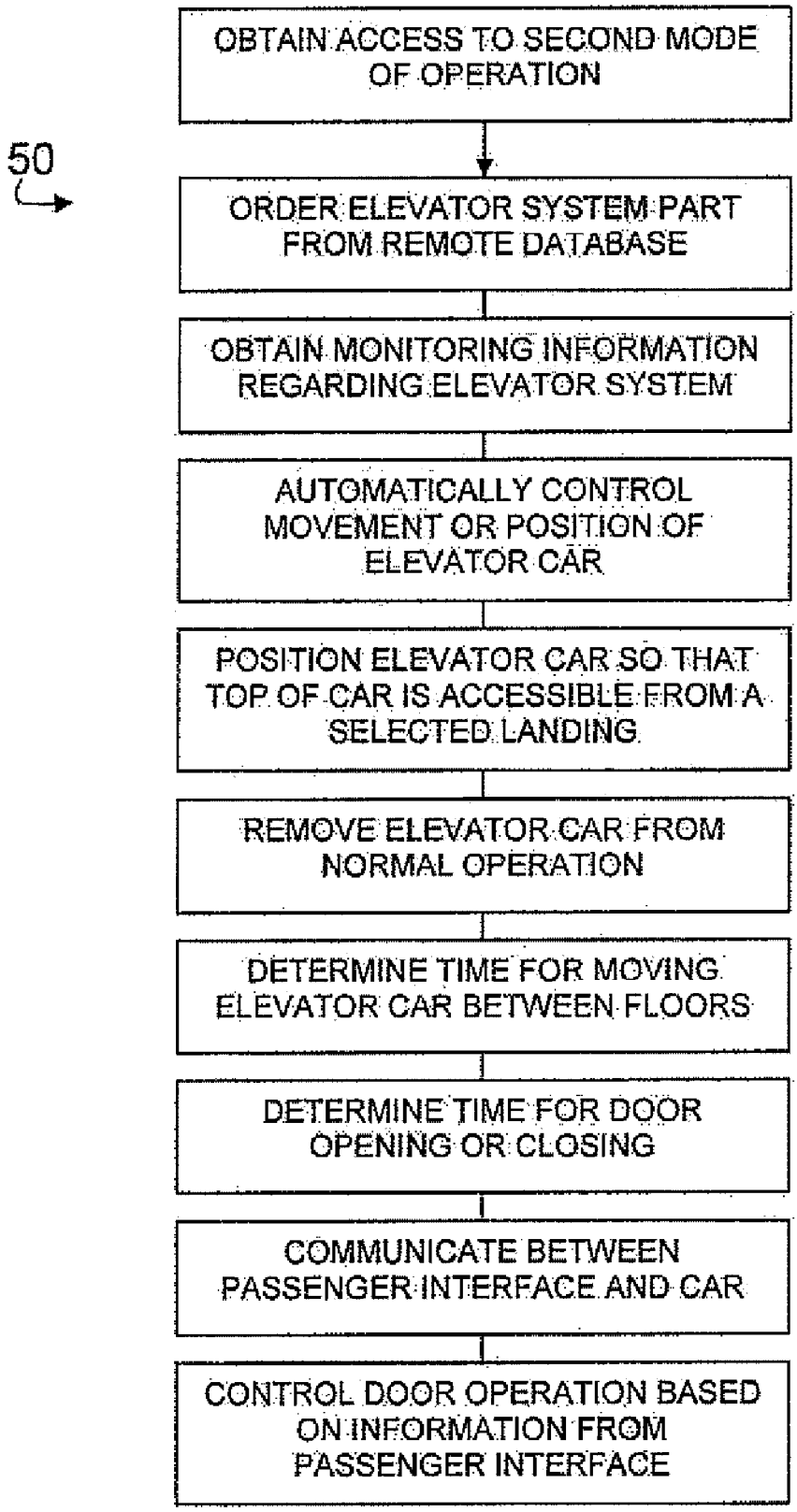
FIG. 2 is a flowchart-style diagram summarizing features of an example embodiment.

The passenger interface 22 is also capable of operating in a second mode, where the passenger interface provides at least one other feature not used during the first mode of operation. FIG. 2 includes a flowchart-style diagram 50 summarizing various features available in an example second mode of operation. In one example, an authorized individual can obtain access to the second mode of operation using the passenger interface 22. Examples of authorized individuals include mechanics, technicians, building managers or building owners. An additional feature provided during the second mode of operation in one example is at least one of a monitoring feature, a service feature, an emergency response feature, a security-related feature or a communication feature. Examples of each are described below.

The passenger interface 22 in one example initiates the second mode responsive to an appropriate authorization signal. In one example, the input portion 28 can be manipulated by an individual to enter a recognizable access code, for example. Depending on the particular application, a password and an authorization code may be required to initiate the second mode of operation. Once initiated, the passenger interface 22 allows the authorized individual access to at least one other feature. That individual may use the input portion 28 or the display 32, for example, to achieve their intended goal.

In the illustrated example, an authorization portion 34 is associated with the passenger interface 22. The authorization portion 34 facilitates receiving an appropriate authorization signal separate from or in combination with an entry into the input portion 28.

One example authorization portion 34 comprises a card reader that reads, for example, a magnetic stripe on a card provided to an authorized individual. Once the second mode of operation is initiated, the input portion 28 may be used by the authorized individual.

Another example authorization portion includes a signal transceiver that is adapted to receive a wireless signal from a device that can be carried by the authorized individual. Example devices for this purpose include signaling devices such as key fobs that require manual activation to transmit a signal, so-called smart cards that automatically transmit a signal, personal digital assistants capable of wireless signal transmission and cellular phones. Those skilled in the art who have the benefit of this description will be able to configure the passenger interface 22 and an authorization portion 34 to facilitate such communications to meet the needs of their particular situation.

One example use of the second mode of operation for the passenger interface 22 is to facilitate a monitoring operation. It may be desirable or necessary for building owner or manager, for example, to monitor the elevator system operation. In the second mode, the passenger interface 22 provides monitoring information on the display 32, for example. With such arrangements, it is possible to provide the type of monitoring information that has been provided through known, separate display devices located in a machine room or another position within a building, for example. By providing such information to a building owner or manager through the passenger interface 22, cost savings are achieved by eliminating the necessity of a separate device to provide the monitoring information. Additionally, the convenience to the building owner or manager increases because they are not required to travel to a machine room or other location in the building for such information.

In one example, the second mode of operation of the passenger interface 22 is used to facilitate a service procedure. A mechanic or service technician can use the passenger interface 22 for various service-related functions. One example includes monitoring the status of the elevator cars 26, their operational modes and motion states, for example. One example includes allowing the technician or mechanic to place specific car calls to specific landings. One example includes input/output monitoring and group monitoring functions.

One example includes the ability for a mechanic to select an elevator car and remove it from normal system operation so that the system controller 30 does not assign that particular car to carry passengers while the mechanic completes the service procedure, for example. In one example, when a selected car is removed from normal system operation, the system controller 30 can still utilize the remaining cars and the passenger interface 22 still facilitates passengers entering intended destinations. In such an example, the passenger interface 22 effectively operates simultaneously in the first and second modes. Such an arrangement has the advantage of allowing a mechanic or technician to service particular portions of an elevator system while not completely interrupting service to passengers.

In one example, a mechanic is able to use the passenger interface 22 for cycling car doors. The display portion 32 provides an indication of the opening and closing door times, for example.

In one example, the mechanic is able to direct an elevator car upward or downward, for example. The display 32 provides information regarding the floor-to-floor times associated with such movement.

One example includes the ability for a mechanic to direct a specific car to a specific position within a hoistway to facilitate accessing the top of that car. For example, a mechanic utilizes the passenger interface 22 to request top of car access to a selected one of the cars at a selected floor. After providing the appropriate authorization codes, the mechanic selects from a menu presented on the display 32 to enter an appropriate operation code corresponding to the desired top of car access. In one example, the passenger interface 22 is located at the level where the mechanic desires to access the top of a car. Because the mechanic is able to select a particular car, the mechanic can pre-install a barricade indicating that the selected car is out of service.

Once the appropriate commands are entered at the passenger interface 22, that device sends appropriate signals to the system controller 30. The system controller 30 removes the selected car out of the normal system operation parameters. Once that car has completed serving any previously assigned destination requests, the system controller 30 dictates operation of appropriate devices in or near a selected car to provide visible and audible signals indicating that the selected car is no longer available for passenger service. The controller 30 then places the selected car into a top of car access initiation mode, any call buttons associated with that car are disabled and the car is sent to an appropriate floor.

Upon arrival at the appropriate floor, the car doors open and visible and audible signals provide an indication that the car is not available for passenger service. After a selected time, such as five seconds, the doors close. The controller then commands the car to move in a downward direction at a reduced speed compared to normal operation and to stop automatically when it reaches a predetermined position to allow safe access to the car top. In one example, the car is commanded to move downward a distance equal to the height of the cab.

As the car begins to descend but before it reaches the predetermined position, the mechanic preferably opens the hoistway door with a known door-unlocking device. At this point the car stops. The mechanic then can wait for a period of time, such as ten seconds, with the hoistway door open to verify that the car does not move when the hoistway door is unlocked while the car doors are closed. This tests and verifies proper operation of the hoistway door lock at the access floor.

In one example, the mechanic then places a car top emergency stop switch to the "stop" position. The hoistway doors are then allowed to close and lock. The mechanic waits a selected time, such as ten seconds, with the landing door closed. The car should not move at this point. Such a procedure allows for testing and verifying proper operation of the car top emergency stop switch. At this point, the mechanic has tested and verified two independent means for controlling the car.

Next, the mechanic can reopen the hoistway doors and verify that the car has not moved. After placing the car top emergency stop switch into the "run" position, the mechanic allows the hoistway doors to close and lock. The controller 30 will next resume moving the car to the predetermined position. Once it arrives there, the mechanic unlocks the hoistway doors, places the car top emergency stop switch in the "stop" position and can access the top of the car.

Returning the car to normal service in one example only occurs after the top of car inspection switch is appropriately set by the mechanic. Once on top of the car, the mechanic can use known techniques and have egress from the hoistway at any landing. Further interaction with the passenger interface 22 is not required for such procedures.

In another example, once the car arrives at the destination dictated by the mechanic's previous entry into the passenger interface 22, the mechanic enters the car and activates the in-car inspection switch. In one example, the inspection switch has a third position in addition to the two typical positions. This third position has a spring return feature so that it only momentarily remains in that position.

In one example, the mechanic is given a selected window of time within which to enter the car and activate the in-car inspection switch. Twenty seconds is provided in one example. If the mechanic does not operate the in-car inspection switch within this time interval, then the car returns to normal operation. Within that time window when the mechanic turns the in-car inspection key switch momentarily to the third position, the mechanic can then remove the key and exit the car. The system responds to such activity by closing the doors and commanding the car to move in a downward direction at the reduced speed. The car in this example stops automatically when it reaches the predetermined position to facilitate appropriate access to the car top.

Providing such specific car positioning control responsive to inputs beginning with at least one at the passenger interface 22 in the second mode of operation enhances the ability of a mechanic to quickly and reliably perform intended service functions.

In one example, the second mode of operation includes facilitating communication with remotely located devices. In one example, the passenger interface 22 can be used to access the internet so that a mechanic can access information from remotely located data bases including such things as service instructions, manuals, wiring diagrams, etc. Such an arrangement is also useful for on-line ordering of replacement parts. Repair instructions or emergency rescue instructions may be provided by video or audio output at the interface device 22 or onto a portable device that communicates wirelessly with the passenger interface 22. In the latter example, the mechanic may be able to move about freely and obtain the necessary information while observing relevant elevator system components.

In one example, the second mode includes emergency response functions such as voice communications between the passenger interface 22 and the interior of a particular elevator car. This allows, for example, a building manager, mechanic or technician to advise passengers trapped within a car that the situation is being addressed. In another example, known remote emergency rescue techniques for elevator systems without machine rooms can be carried out using the passenger interface 22.

In one example, the second mode of operation includes providing at least one security-related function such as allowing an authorized individual to observe the interior of elevator cars using the display 32, for example. This allows an individual to verify a situation before opening car doors, for example. Another example security feature includes commanding a particular car to a particular floor and controlling whether the doors open so that the location of individuals within the car is controllable.

A variety of features of a second mode of operation are disclosed above. More than one of these can be included in any particular embodiment. Those skilled in the art who have the benefit of this description will realize what combination of such features will best meet the needs of their particular situation. Additionally, given this description, those skilled in the art will be able to appropriately configure a passenger interface 22 and a system controller or related components to carry out the features as required to meet the needs of their particular situation.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim

1. A device for use in an elevator system, comprising:

a passenger interface that operates in a first mode to allow a passenger to enter an indication of an intended destination from outside of an elevator car and a second mode to provide at least one other feature to an authorized individual, wherein the one other feature comprises facilitating a service procedure that includes ordering an elevator system part from a remotely located source of the part.

2. The device of claim 1, wherein the passenger interface initiates the second mode responsive to an authorization signal.

3. The device of claim 2, wherein the passenger interface includes an input portion useful in the first mode and wherein the authorized individual uses the input portion to provide the authorization signal.

4. The device of claim 3, wherein the authorization signal comprises an access code.

5. The device of claim 2, wherein the passenger interface includes an authorization portion for receiving the authorization signal.

6. The device of claim 5, wherein the authorization portion comprises at least one of a receiver for receiving a wirelessly transmitted signal or a scanner for scanning an item placed in proximity to the scanner.

7. The device of claim 2, wherein the passenger interface initiates a first level second mode responsive to a first authorization signal and a second level second mode responsive to a second, different authorization signal.

8. The device of claim 1, wherein the service procedure comprises monitoring a selected portion of the elevator system.

9. The device of claim 1, wherein the service procedure includes automatically controlling a position of a selected elevator car.

10. The device of claim 9, wherein the service procedure includes automatically positioning the selected elevator car so that a top of the car is accessible from a selected landing.

11. The device of claim 1, wherein the service procedure includes at least temporarily removing a selected elevator car from normal operation.

12. The device of claim 1, wherein the service procedure includes determining a time associated with moving an elevator car between floors.

13. The device of claim 1, wherein the service procedure includes determining at least one time associated with at least one of opening or closing an elevator car door.

14. The device of claim 1, wherein the service procedure comprises facilitating an emergency response procedure.

15. The device of claim 14, wherein the emergency response procedure includes communicating between the passenger interface and a selected elevator car.

16. The device of claim 14, wherein the emergency response procedure includes using the passenger interface for controlling movement of a selected elevator car.

17. The device of claim 1, wherein the service procedure comprises selectively controlling operation of doors of a selected elevator car based at least in part on information regarding an interior of the selected elevator car obtained through the passenger interface.

18. The device of claim 1, wherein the passenger interface operates simultaneously in the first and second modes.

19. The device of claim 1, including a receiver for receiving a wirelessly transmitted signal used for the second mode.

20. A method of using a destination entry passenger interface for an elevator system, comprising the steps of:

operating the passenger interface in a first mode to allow a passenger to provide an indication of an intended destination; and operating the passenger interface in a second mode to provide at least one other feature to an authorized individual for conducting a service procedure that includes ordering an elevator system part from a remotely located source of the part.

21. The method of claim 20, wherein operating in the second mode includes at least facilitating one of a monitoring procedure, an emergency response procedure or a security procedure.

22. The method of claim 20, wherein operating in the second mode includes automatically controlling a position of a selected elevator car responsive to input at the passenger interface.

23. The method of claim 22, including automatically positioning the selected elevator car such that a top of the car is accessible from a selected landing.

24. The method of claim 20, including operating in the first and second modes simultaneously.

* * * * *